United States Patent [19]

Pozzobon et al.

[11] Patent Number: 5,065,530

[45] Date of Patent: Nov. 19, 1991

[54] CLOSURE DEVICE, PARTICULARLY FOR SKI BOOTS

[75] Inventors: Alessandro Pozzobon, Paderno di Ponzano Veneto; Roberto Gorza, Feltre, both of Italy

[73] Assignee: Nordica S.p.A., Montebelluna, Italy

[21] Appl. No.: 437,232

[22] Filed: Nov. 16, 1989

[30] Foreign Application Priority Data

Nov. 22, 1988 [IT] Italy ..... 82610 A/88

[51] Int. Cl.[5] ..... A43B 11/00; A43B 5/04

[52] U.S. Cl. ..... 36/50; 36/117; 24/68 SK

[58] Field of Search ..... 36/117–121, 36/50; 24/68 SK, 69 SK, 71 SK

[56] References Cited

U.S. PATENT DOCUMENTS

| | | | |
|---|---|---|---|
| 4,519,150 | 5/1985 | Arieh et al. | 36/50 X |
| 4,677,768 | 7/1987 | Benoit et al. | 36/50 X |
| 4,711,042 | 12/1987 | Morell et al. | 36/50 |
| 4,765,069 | 8/1988 | Baggio et al. | 36/50 |
| 4,821,433 | 4/1989 | Marxer | 36/50 X |
| 4,893,419 | 1/1990 | Arieh et al. | 36/50 X |
| 4,908,965 | 3/1990 | Iwama | 36/50 X |
| 4,922,633 | 5/1990 | Sartor | 36/50 X |
| 5,003,711 | 4/1991 | Nerrinck et al. | 36/50 X |

*Primary Examiner*—Paul T. Sewell
*Assistant Examiner*—Ted Kavanaugh
*Attorney, Agent, or Firm*—Guido Modiano; Albert Josif

[57] ABSTRACT

A closure device particularly for ski boots composed of a shell with which a front quarter and a rear quarter are associated. The device is constituted by at least one traction element which has at least one point which is fixed, when the quarter opens or closes, to a moving part of the boot and at least one portion which is slidably associated with a static part of the boot. The traction element, which is advantageously non-extendable, furthermore interacts with means for tensioning and locking the cable.

4 Claims, 3 Drawing Sheets

CLOSURE DEVICE, PARTICULARLY FOR SKI BOOTS

BACKGROUND OF THE INVENTION

The present invention relates to a closure device particularly for rear-entry ski boots.

Several types of devices adapted to close the quarters of a rear-entry ski boot are currently known.

Many of said known devices employ cables which are tensioned with such means as, for example, levers.

U.S. Pat. No. 4,160,322 and U.S. Pat. No. 4,735,004 disclose devices of this type.

For functional reasons, in these known closure systems the cable end is fixed to the lever at a distance from the pivot of the lever itself, in order to allow the quarters to open enough to insert or remove the foot.

In said known types of device, the cable tensioning means must also completely recover said cables.

Because of these functional requirements, some disadvantages are thus observed, such as a considerable strain for closing the quarters due to the distance between the cable end fixed on the lever and the lever pivot, and to the fact that the cable must be recovered.

Furthermore, in order to close the quarters completely, known devices have means for adjusting the working length of the cables, these means having to recover a great cable length.

Known devices which use vertical levers also have the disadvantage of forcing the user to exert an effort which must move the lever beyond the point of the cable maximum tension in order to complete the lever rotation.

An aesthetically disadvantageous aspect is finally observed, and is constituted by the fact that when joining the rear quarter to the front one, in order to close said quarters, the cables are completely slackened.

SUMMARY OF THE INVENTION

The aim of the present invention is therefore to eliminate the disadvantages described above in known types by providing a device which can be applied to a rear-entry ski boot and allows to close the quarters effortlessly.

Within the scope of the above described aim, an important object is to provide a device which allows a satisfactory opening of the quarters.

Another object is to provide a device which allows the rapid closure of the quarters.

Still another object is to provide a device which, despite using cables as traction elements, does not use complicated and bulky means for recovering them.

Another object is to provide a device in which the cables have no slackened portions when the quarters are adjacent.

Not least object is to provide a device which associates with the preceding characteristics that of being structurally simple as well as reliable and safe in use.

This aim, these objects and others which will become apparent hereinafter are achieved by a closure device, particularly for ski boots comprising a shell, a front quarter and a rear quarter, characterized in that it comprises at least one traction element which has at least a first end fixed to a static part of said boot and at least a second end associated with a moving part of said ski boot, at least one portion of said cable being slidably associated with a moving part of said boot, said at least one traction element interacting with means for tensioning and locking said cable.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
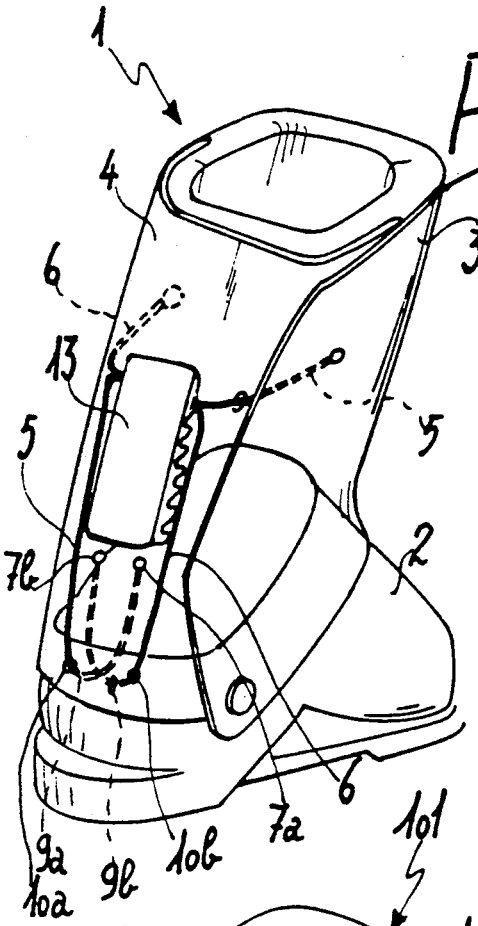
FIG. 1 is an isometric rear view of the device applied to a ski boot, with the quarters closed.
Figure 2:
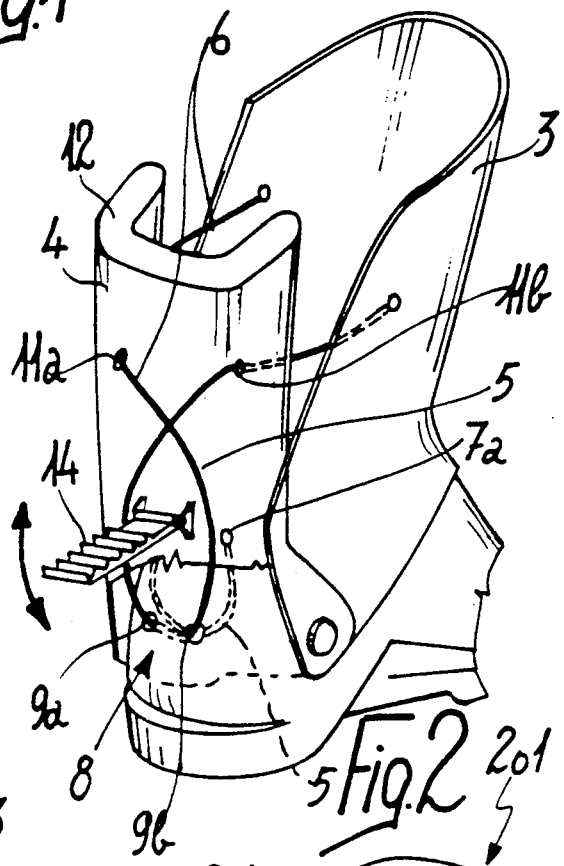
FIG. 2 is the same view of FIG. 1, but with the quarters open.

With reference to FIGS. 1 and 2, the reference numeral 1 indicates a rear-entry ski boot constituted by a shell 2 with which a front quarter 3 and a rear quarter 4 are associated.

The closure device is constituted, in the particular embodiment, by a first traction element and by a second traction element which are advantageously non-extendable and are constituted by a first cable 5 and by a second cable 6.

Said first cable and said second cable have a first end, respectively indicated by the reference numerals 7*a* and 7*b*, which, in this case, is coupled internally to the rear quarter 4 so as to be fixed to a moving part of the boot, the term "moving" referring to the opening and closing motion of the rear quarter 4.

Said first cable and said second cable furthermore have a portion slidably associated with a static part of said boot and inserted in a first hole provided on the shell 2 at the heel region 8; said first hole is respectively indicated by the reference numerals 9*a* and 9*b* for said first cable and for said second cable.

In the particular embodiment, said first cable and said second cable cross one another before they respectively insert in said first holes 9*a* and 9*b* provided on the shell 2.

Second holes, indicated by the reference numerals 10*a* and 10*b*, are furthermore provided on the rear quarter 4 at said first holes 9*a* and 9*b*, and are adapted to allow said first cable and said second cable to exit from the rear quarter.

Said first cable and said second cable subsequently have a portion which is arranged approximately longitudinally to the rear quarter and then cross one another again so as to respectively affect third holes, indicated by 11*a* and 11*b*, provided at the rear quarter 4 proximate to the upper edge 12.

Said first cable and said second cable then have a portion which is also internal to the front quarter 3, and their ends are laterally connected to said front quarter.

A lever 13 is transversely articulated in the interspace between said second and third holes on said rear quarter and has a plurality of engagement teeth 14 for said first cable and said second cable.

The operation of the device is as follows: when the lever is open, as illustrated in FIG. 2, the opening or the closure of the rear quarter with respect to the front quarter entails the recovery of most of the working length of said first cable and said second cable.

Since the first ends *7a* and *7b* are in fact rigidly associated with the rear quarter (which rotates with respect to the axis of pivoting to the shell 2), and since said cables slide at the holes defined on the shell 2, which is in itself not affected during the opening of the rear quarter, the dynamic interaction between the rear quarter and the cable is exploited to achieve a considerable recovery of the working length of said cables.

The function of the lever 13 is exclusively that of eventually tension said first cable and said second cable so as to close the quarters completely.

An adjustment system may optionally be arranged either at the lever or be associated with an end of said first cable and said second cable.

It has thus been observed that the invention achieves the intended aim and objects, a device having been provided for closing the quarters with a substantially reduced effort, the skier having to recover just a short portion of the working length of the cables by actuating the lever.

Said lever is furthermore automatically preset for the final closure, and it is not necessary to start from a position which is substantially at 180° from the closure position as in known devices.

Once the lever has been opened, the quarters are sufficiently spread apart because of the peculiar arrangement of the cables, thus facilitating the insertion of the foot into the shell and its extraction.

The device thus provided is furthermore structurally very simple and is of a very small size.

The invention thus conceived is naturally susceptible to numerous modifications and variations, all of which are within the scope of the same inventive concept.

Figure 3:
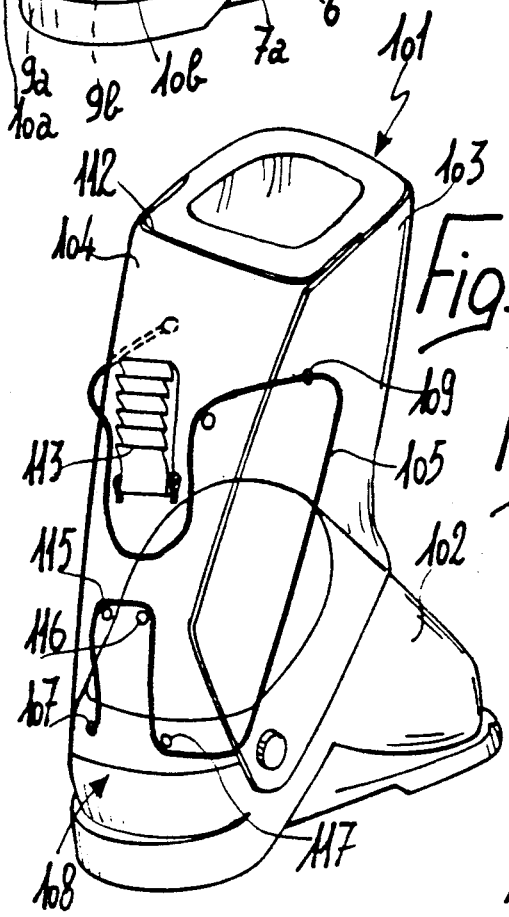
FIGS. 3, 4 and 5 are isometric rear views of ski boots having devices according to further aspects of the invention.

Thus, for example, FIG. 3 illustrates a second embodiment of a boot 101 in which the closure device is constituted by a single cable 105 having a first end 107 rigidly associated with the shell 102 at the heel region 108.

Said cable 105 subsequently defines a U-shaped configuration with the base of the U directed toward the upper edge 112 of the rear quarter 104; said configuration is obtained by providing, at said rear quarter, a first guide member 115 and a second guide member 116 arranged along a transverse axis with respect to said rear quarter.

The cable 105 is then again guided at a third guide member 117 associated with the shell 102 approximately at the same height as the fixing point of the first end 107.

The cable thus follows a path along the inner lateral region of the quarters until it exits from the front quarter 103 through a first hole 109 provided laterally to said front quarter.

The cable then embraces the rear quarter and is then laterally coupled at its other end to the front quarter 103 on the opposite side with respect to the first hole 109.

In this case, too, a lever 113 is provided for the final tensioning of the cable 105 and is pivoted outside and rearwardly with respect to the rear quarter 104 and thus affects the portion of the cable which embraces said rear quarter.

Figure 4:
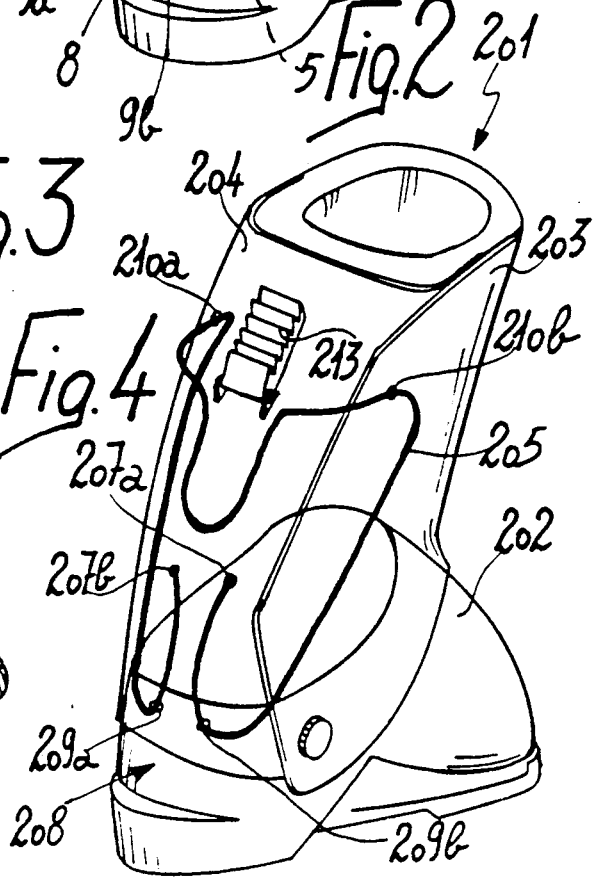

FIG. 4 illustrates a third embodiment of a boot 201 in which the closure device is again constituted by a single cable 205 having symmetrical paths with respect to the longitudinal middle axis of the quarters; the ends 207*a* and 207*b* of the cable are then rigidly associated inside the rear quarter and thus to a point of a moving part of a boot.

Then, similarly to the first embodiment but without crossings, the cable slides freely at adapted first holes 209*a* and 209*b* provided on the shell 202 at the heel region 208.

The cable then develops in the inner lateral regions of the quarters and exits at adapted second holes 210*a* and 210*b* which are defined laterally to the front quarter 203, and then has a portion which embraces the rear quarter 204 where the lever 213 is provided.

Figure 5:
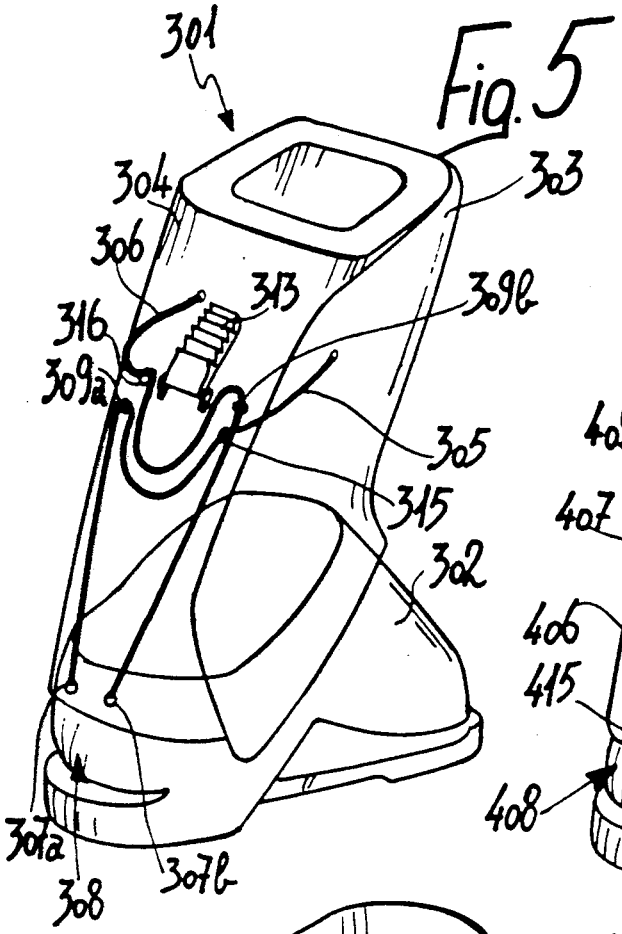

FIG. 5 illustrates a fourth embodiment of a boot 301 in which the closure device is constituted by a first cable 305 and by a second cable 306.

Said first cable and said second cable also have, like the preceding example, a symmetrical path with respect to the plane which is longitudinal to the quarters.

Said first cable and said second cable thus have a first end 307*a* and 307*b* rigidly associated at two adjacent points of the shell 302 at the heel region 308.

Said first cable and second cable are then arranged longitudinally inside the rear quarter 304 and then exit rearward from said rear quarter at adapted first holes 309*a* and 309*b* which are arranged at mutually parallel planes which are transverse with respect to the rear quarter.

Said first cable and said second cable have a portion embracing the rear region of said rear quarter which bears the lever 313, and are then guided respectively at a first guide member 315 and at a second guide member 316 associated with the rear quarter respectively at the plane of arrangement of said first holes 309*a* and 309*b*.

The other ends of the first cable and of the second cable are then associated at a lateral region with respect to the front quarter 303.

Figure 6:
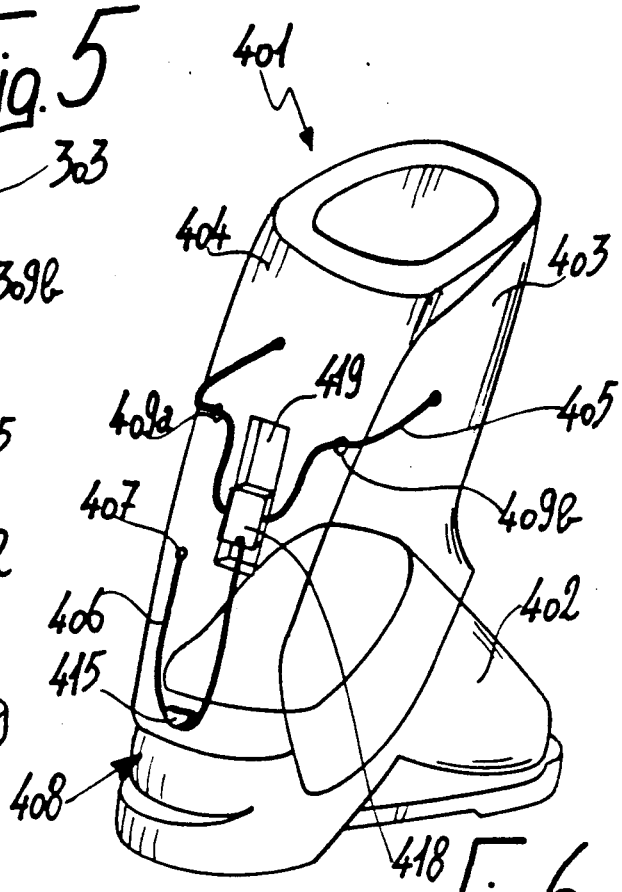
FIGS. 6 and 7 are isometric rear views of a ski boot, respectively with closed and open quarters, having a device according to still a further aspect of the invention.
Figure 7:
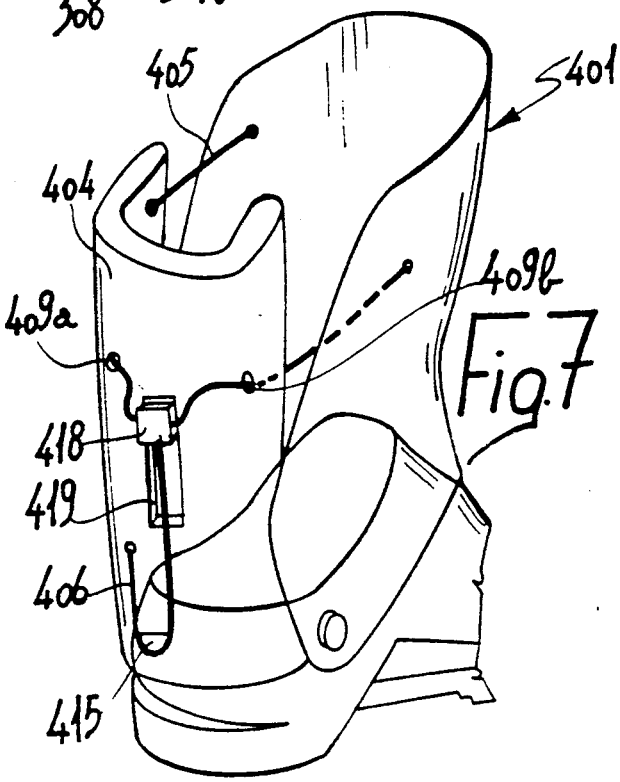

FIGS. 6 and 7 illustrates a fifth embodiment of a boot 401 in which the closure device is constituted by a first traction element portion or cable 405 which has its first parts of ends rigidly associated laterally to the front quarter 403 and exits from the rear quarter 404 through adapted first holes 409*a* and 409*b* provided at the rear side of the rear quarter.

Said first cable is then associated at a second part thereof with a slider 418 which is slidable at an adapted longitudinal seat 419 provided rearward to the rear quarter 404.

The closure device furthermore comprises a second traction element portion A cable 406 which has a third party or end 407 rigidly associated inside the rear quarter 404 in a region which overlies the heel region 408 of the shell 402.

The second cable 406 is then guided at a second part thereof, at an adapted first guide member 415 provided on said shell 402 at the region 408 of the heel and is then rigidly associated, at a first part thereof, with the slider 418.

The means for tensioning said first cable and said second cable and/or for locking their sliding may be constituted by a lever 413 which is pivoted transversely to the rear quarter 404 and has, at the surface directed toward said rear quarter, a rod 420 which engages the end of said slider 418 which is opposite to the end which engages said second cable 406.

Figure 9:
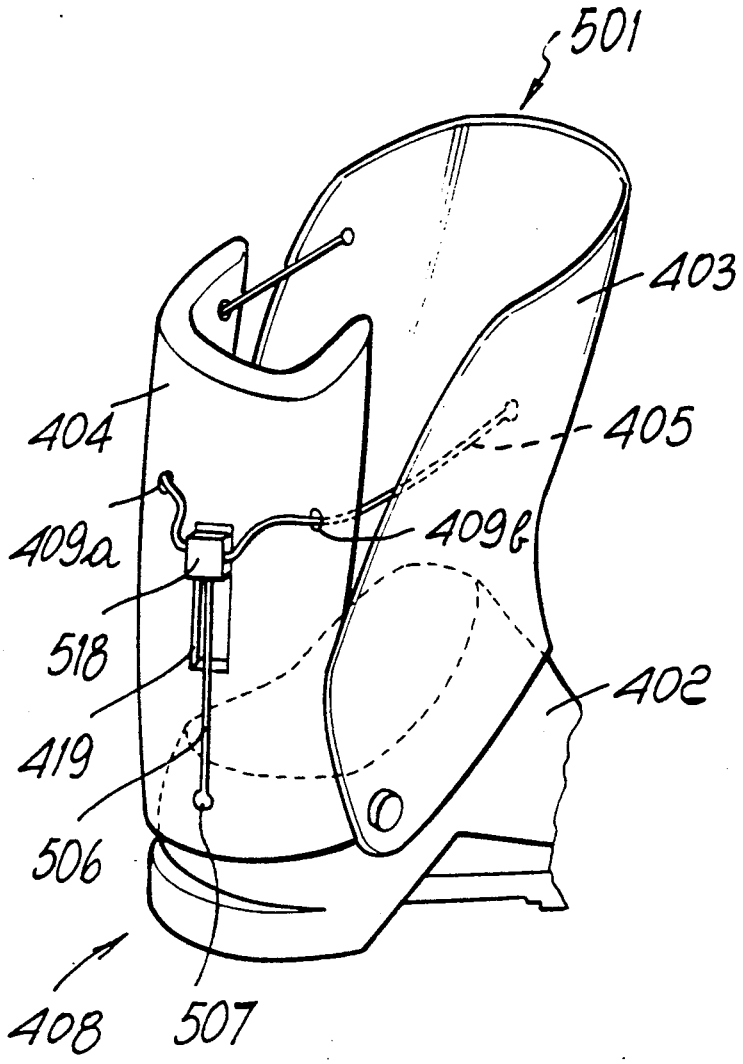
FIG. 9 is a partial isometric rear view of a ski boot according to another aspect of the invention.

FIG. 9 shows a further example of a ski boot 501 according to the invention and similar to ski boot 401 of FIGS. 6 and 7, except for the different layout of cable 506. In this case, the cable 506 is associated with the slider 518 at an end or first part thereof, as in the preceding example, and has its second part or end 507 associated with the shell 402 of the ski boot. Those elements of FIG. 9 designated with the same numerals of FIGS. 6 and 7 are similar to the elements of the same FIGS. 6, 7.

Figure 8:
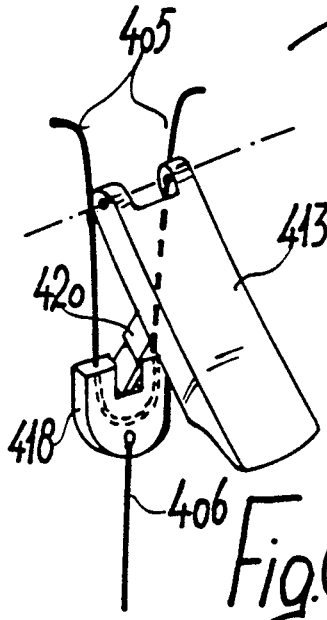
FIG. 8 is an isometric side view of a lever of the device shown in FIGS. 6 and 7.

Also in this case, a lever 413, as illustrated in FIG. 8, may be used to tension the cables.

The materials and the dimensions which constitute the individual components of the device may naturally be the most pertinent according to the specific requirements.

We claim:

1. Closure device, particularly for rear-entry ski boots comprising a shell and a front quarter and a rear quarter both connected to said shell, said shell defining a heel region, said closure device comprising a first traction element, a second traction element, and a slider element, said rear quarter being provided with a longitudinal seat in which said slider element is slidingly guided, said first traction element defining end portions and a middle portion between said end portions, said end portions of said first traction element being fixedly connected to opposite lateral sides of said front quarter, said middle portion of said first traction element being fixedly connected directly to said slider element, said second traction element defining a first end and a second end, said first end of said second traction element being fixedly connected to said slider element, said second traction element extending directly downwardly from said first end to said second end which is fixedly connected to said heel region of said shell, said closure device further comprising means for locking said slider element in a fixed position in said longitudinal seat.

2. Closure device according to claim 1, wherein said means for locking said slider element in a fixed position comprise a lever which is pivotally connected at a fixed point on said rear quarter.

3. Closure device, particularly for rear-entry ski boots comprising a shell and a front quarter and a rear quarter both connected to said shell, said shell defining a heel region, said closure device comprising a first traction element, a second traction element, and a slider element, said rear quarter being provided with a longitudinal seat in which said slider element is slidingly guided, said first traction element defining end portions and a middle portion between said end portions, said end portions of said first traction element being fixedly connected to opposite lateral sides of said front quarter, said middle portion of said first traction element being fixedly connected directly to said slider element, said second traction element defining a first end, a second end, and a middle part between said first and second ends, said first end of said second traction element being fixedly connected to said slider element, said second traction element extending directly downwardly from said first end to said middle part which is guided at a guide member provided at said heel region of said shell, and said second traction element extending directly back upwardly from said guide member to said second end which is fixedly connected to said rear quarter, said closure device further comprising means for locking said slider element in a fixed position in said longitudinal seat.

4. Closure device according to claim 3, wherein said means for locking said slider element comprise a lever which is pivotally connected at a fixed point on said rear quarter.

* * * * *